US008823618B2

(12) United States Patent
Lee et al.

(10) Patent No.: US 8,823,618 B2
(45) **Date of Patent: *Sep. 2, 2014**

(54) COLOR CORRECTION LIQUID CRYSTAL DISPLAY AND METHOD OF DRIVING SAME

(75) Inventors: Seung-Woo Lee, Seoul (KR); Jong-Seon Kim, Pyeongtaek (KR); Su-Hyun Kwon, Suwon (KR)

(73) Assignee: Samsung Display Co., Ltd. (KR)

( * ) Notice: Subject to any disclaimer, the term of this patent is extended or adjusted under 35 U.S.C. 154(b) by 33 days.

This patent is subject to a terminal disclaimer.

(21) Appl. No.: 12/824,126

(22) Filed: Jun. 25, 2010

(65) Prior Publication Data

US 2010/0309234 A1 Dec. 9, 2010

Related U.S. Application Data

(63) Continuation of application No. 11/214,787, filed on Aug. 31, 2005, now Pat. No. 7,746,304, which is a continuation of application No. 09/901,137, filed on Jul. 10, 2001, now Pat. No. 7,030,846.

(30) Foreign Application Priority Data

Jul. 10, 2001 (KR) ..... 2001-41186

(51) Int. Cl.
*G09G 3/36* (2006.01)

(52) U.S. Cl.
USPC ..... 345/89; 345/88; 345/690

(58) Field of Classification Search
CPC . G09G 3/2003; G09G 3/2007; G09G 3/3607; G09G 2320/03673; G09G 2320/0276
USPC ..... 345/87–89, 601, 602, 605, 690; 348/671, 674
See application file for complete search history.

(56) References Cited

U.S. PATENT DOCUMENTS

| | | | |
|---|---|---|---|
| 4,779,083 | A | 10/1988 | Ishii et al. |
| 4,827,255 | A | 5/1989 | Ishii et al. |
| 5,196,738 | A | 3/1993 | Takahara et al. |
| 5,359,342 | A | 10/1994 | Nakai et al. |
| 5,495,265 | A | 2/1996 | Hartman et al. |
| 5,528,257 | A | 6/1996 | Okumura et al. |
| 5,777,590 | A | 7/1998 | Saxena et al. |
| 6,075,514 | A | 6/2000 | Ryan |
| 6,462,735 | B2 | 10/2002 | Naito |
| 2001/0045946 | A1 | 11/2001 | Huang et al. |
| 2002/0180680 | A1 | 12/2002 | Moon |

FOREIGN PATENT DOCUMENTS

| | | | |
|---|---|---|---|
| EP | 0951007 | | 10/1999 |
| EP | 0994379 | A3 | 4/2000 |
| JP | 02-271389 | A | 11/1990 |
| JP | 03-18822 | | 1/1991 |
| JP | 06-214523 | A | 8/1994 |
| JP | 10-504118 | | 3/1997 |

(Continued)

*Primary Examiner* — Regina Liang
(74) *Attorney, Agent, or Firm* — Innovation Counsel LLP

(57) ABSTRACT

A liquid crystal display includes a liquid crystal display panel for displaying picture images, and a color correction unit. Upon receipt of raw RGB picture data corresponding to raw RGB gamma curves, the color correction unit generates corrected RGB picture data based on values over a predetermined imaginative gamma curve established in accordance with the characteristic of the liquid crystal display panel. The color correction unit stores values over corrected RGB gamma curves corresponding to the corrected picture data, and gamma-corrects the raw RGB picture data based on values over the stored corrected RGB gamma curves, thereby displaying the picture images.

12 Claims, 17 Drawing Sheets

(56) References Cited

FOREIGN PATENT DOCUMENTS

| | | | |
|---|---|---|---|
| JP | 09-319334 | A | 12/1997 |
| JP | 10-301533 | | 11/1998 |
| JP | 11-015444 | | 1/1999 |
| JP | 11-183894 | | 7/1999 |
| JP | 11-311976 | | 11/1999 |
| JP | 2000-010532 | A | 1/2000 |
| JP | 2000-20037 | | 1/2000 |
| JP | 2000-56525 | | 2/2000 |
| JP | 2000-075838 | A | 3/2000 |
| JP | 2000-82138 | | 3/2000 |
| JP | 2000-99684 | | 4/2000 |
| JP | 2001-008219 | A | 1/2001 |
| JP | 2001-042833 | A | 2/2001 |
| JP | 2001-134242 | | 5/2001 |
| JP | 2001-222264 | | 8/2001 |
| JP | 2003-015612 | A | 1/2003 |
| KR | 2000-0020842 | | 4/2000 |
| WO | 96/18124 | | 6/1996 |

COLOR CORRECTION LIQUID CRYSTAL DISPLAY AND METHOD OF DRIVING SAME

CROSS-REFERENCE TO RELATED APPLICATIONS

This is a continuation application of U.S. patent application Ser. No. 11/214,787, filed Aug. 31, 2005, which is a continuation of U.S. patent application Ser. No. 09/901,137, now U.S. Pat. No. 7,030,846, which claims priority from Korean Patent Application No. 2001-41186, filed Jul. 10, 2001, the contents of each of which are herein incorporated by reference in their entireties and for all purposes.

BACKGROUND OF THE INVENTION (a) Field of the Invention

The present invention relates to a liquid crystal display and a method of driving the same and, more particularly, to a liquid crystal display which has a function of making adaptive color correction.

(b) Description of the Related Art

As personal computers and televisions become thinner and flatter, flat panel type display devices such as liquid crystal displays have developed, and have been employed for practical use in various fields instead of cathode ray tubes.

The liquid crystal display has two substrates, and a liquid crystal sandwiched between the two substrates with a property of dielectric anisotropy. In operation, an electric field is applied to the liquid crystal while being controlled in strength thereof. In this way, the light transmission through the liquid crystal is controlled to thereby display the desired picture images.

Such a liquid crystal display exhibits the so-called inter-gray scale color shift phenomenon in various modes such as TN and ECB.

First, in the modes of TN, ECB and CE, the light transmission is determined by the following mathematical formulas 1 to 3, respectively.

$$T=1-((\sin^2(\pi/2\sqrt{(1+u^2)}))/1+u^2), \text{ for } TN \quad (1)$$

where $u=2\Delta nd/\lambda$.

$$T=\tfrac{1}{2}\sin^2(\pi\Delta nd/\lambda)=\tfrac{1}{2}\sin^2((\pi/2)u), \text{ for } ECB \quad (2)$$

$$T=\sin^2(2\theta)\sin^2((\pi/2)u), \text{ for } CE \quad (3)$$

In the mathematical formulas 1 to 3, with the variation in voltage, the value of u being in inverse proportion to the wavelength is altered in the case of TN or ECB mode, while the value of θ is altered in the case of CE mode.

That is, in case the liquid crystal molecules are aligned in the vertical direction while being altered in the effective value of Δnd, the light transmission is differentiated per each wavelength bearing intrinsic diffusion characteristics. This is expressed in the mathematical formulas 1 and 2 with the presence of λ at the denominator of u.

By contrast, in the case of CE mode, the light transmission is not differentiated at the respective wavelengths even if the driving voltage is varied.

FIG. 1 is a graph illustrating the difference in light transmission at the wavelengths of 450 nm and 600 nm as a function of Δnd in the TN and ECB modes. The maximum values of light transmission at the ECB and TN modes are about 0.27 nm and 0.47 nm, respectively. Such light transmission values are divided by the value of X.

As shown in FIG. 1, since the light transmission at lower wavelengths becomes higher with the middle gray scales in the TN and ECB modes, the graph is protruded in the direction of plus (+), and this inclination is somewhat stronger in the ECB mode than in the TN mode. For this reason, the inter-gray scale color shift phenomenon becomes serious in the ECB or TN mode.

FIG. 2 is a graph illustrating the graph values of FIG. 1 divided by the light transmission.

As shown in FIG. 2, blue sensation is made at the low gray scales, while the color sensation becomes yellowish at the higher gray scales.

The inter-gray scale color shift phenomenon is generated to be more serious in the VA mode than in the TN mode. The color shift phenomenon is relatively weak in the TN mode compared to the VA mode due to the effect of light revolution where the light transmitted through a target material is rotated by a predetermined angle with respect to the polarizing surface for the incident light.

In the presence of such a color shift phenomenon, color sensation is altered depending upon the gray levels.

FIG. 3A illustrates the color sensations per gray patterns, and FIG. 3B illustrates the color sensations per gray patterns in a usual PVA mode liquid crystal display.

As shown in the drawings, the bright grays involve much of the red content, and the dark grays involve much of blue content. Accordingly, even in the display of an arbitrary middle gray scale, it appears to be more bluish while coming towards the dark gray. In case a personal face is displayed, the blue-based color sensation is made while producing a feeling of coldness.

The reason that such a difference in color sensation is made can be found through measuring gamma curves of R, G and B in a separate manner.

FIG. 4 is a graph illustrating the variation in color coordinates per white grays in the PVA mode. As known from the graph, the movement range of the color coordinates of white grays is very great.

FIG. 5 is a graph illustrating the color temperatures per usual grays. The color temperature refers to the temperature of a black body irradiating the light of the same color coordinates as the light from a light source.

In gray scale expressions, it is ideal to have a constant color temperature irrespective of increase or decrease in the gray levels. However, as known from the graph of FIG. 5, the actual situation is that the color temperature is radically elevated while coming towards a dark level (or a black level).

FIG. 6 illustrates the RGB gamma curves in a usual PVA LCD panel. Of course, the brightness levels per grays in the RGB gamma curves are differentiated, but normalized in the drawing.

As shown in FIG. 6, the RGB gamma curves are not agreed to each other while being differentiated in distance. That is, as it comes toward the dark gray level, the G content or the R content is approximated to zero, and only the B content involves a brightness level higher than zero. Consequently, the screen image appears to be very bluish to the eye of the beholder.

SUMMARY OF THE INVENTION

It is an object of the present invention to provide a liquid crystal display which has a function of adaptive color correction while securing constant color sensation.

It is another object of the present invention to provide a driving unit for a liquid crystal display which has a function of adaptive color correction.

It is still another object of the present invention to provide a method of driving a liquid crystal display with a function of adaptive color correction.

These and other objects may be achieved by a liquid crystal display with the following features.

According to one aspect of the present invention, the liquid crystal display includes a liquid crystal display panel for displaying picture images, and a color correction unit.

Upon receipt of raw RGB picture data corresponding to raw RGB gamma curves, the color correction unit generates corrected RGB picture data based on values over a predetermined imaginative gamma curve established in accordance with the characteristic of the liquid crystal display panel. The color correction unit stores values over corrected RGB gamma curves corresponding to the corrected picture data, and gamma-corrects the raw RGB picture data based on values over the stored corrected RGB gamma curves.

The number of bits in the corrected picture data is altered through making bit extension with respect to the raw picture data. The imaginative gamma curve is the G gamma curve adapted to the G picture data, and the corrected gamma curves are approximated to the G gamma curve.

The liquid crystal display panel makes the display in a VA or PVA mode.

According to another aspect of the present invention, the liquid crystal display includes a vertically aligned mode liquid crystal display panel for displaying picture images, and a color correction unit.

Upon receipt of raw RGB picture data corresponding to raw RGB gamma curves, the color correction unit transforms the raw RGB picture data into corrected RGB picture data based on values over a predetermined imaginative gamma curve established in accordance with the characteristic of the vertically aligned mode liquid crystal display panel. The color correction unit stores values over corrected RGB gamma curves corresponding to the transformed corrected picture data, and gamma-corrects the raw RGB picture data based on values over the stored corrected RGB gamma curves.

The liquid crystal display panel makes the display in a VA or PVA mode.

The corrected gamma curves intercept overlapping of the input picture data through gray scale extension.

According to still another aspect of the present invention, the liquid crystal display includes a liquid crystal display panel with an internal layer of liquid crystal with a predetermined property, a plurality of gate lines transmitting scanning signals, a plurality of data lines transmitting picture signals, and switching circuits connected to the gate and the data lines. A scan driver sequentially applies gate on voltages for turning-on the switching circuits to the gate lines, and a data driver applies data voltages for representing picture signals to the data lines. A control unit, at initial driving, generates corrected picture data corresponding to raw RGB picture data fed from the outside while storing the corrected picture data into a predetermined memory. After the initial driving, upon receipt of raw RGB picture data from the outside, the control unit extracts corrected picture data corresponding to the raw RGB picture data from the memory while transmitting the extracted picture data to the data driver. The control unit generates timing signals for controlling the operation of the scan driver and the data driver while outputting the generated timing signals to the scan driver and the data driver, respectively.

It is preferable that the control unit receives picture signals corresponding to respective RGB gamma curves from the outside, normalizes the RGB gamma curves into one gamma curve, and controls the gray scale levels of the picture signals input from the outside based on the normalized gamma curve.

The control unit may include a color correction unit, and a timing control unit.

The color correction unit, at initial driving, receives raw RGB picture data from an external graphic controller, and transforms the raw RGB picture data into corrected picture data while storing the corrected picture data into the memory. After the initial driving, upon receipt of raw RGB picture data from the outside, the color correction unit extracts the corrected picture data corresponding to the raw RGB picture data from the memory, and transforms the extracted picture data into multi-gray scales.

The timing control unit outputs the transformed picture data to the data driver, and generates timing signals for controlling the operation of the scan driver and the data driver while outputting the generated timing signals to the scan driver and the data driver, respectively.

Alternatively, the control unit may include a timing control unit and a color correction unit each with the following features.

The timing control unit generates timing signals for controlling the operation of the scan driver and the data driver while outputting the generated timing signals to the scan driver and the data driver, and outputs the raw RGB picture data input from the outside.

The color correction unit, at initial driving, receives raw RGB picture data from an external graphic controller, and transforms the raw RGB picture data into corrected picture data while storing the corrected picture data into the memory. After the initial driving, the color correction unit, upon receipt of raw RGB picture data from the outside, extracts the corrected picture data corresponding to the raw RGB picture data from the memory, and transforms the extracted picture data into multi-gray scales while outputting the transformed picture data to the data driver.

According to still another aspect of the present invention, the liquid crystal display includes a layer of liquid crystal with a predetermined property, a plurality of gate lines, a plurality of data lines crossing over the gate lines while being insulated from the gate lines, and pixels surrounded by the gate and data lines each with a switching circuit connected to the corresponding gate and the data lines. The pixels are arranged in a matrix form.

The driving unit for the liquid crystal display includes a scan driver sequentially applying gate on voltages for turning-on the switching circuits to the plurality of gate lines, a data driver applying data voltages for representing picture signals to the data lines, and a control unit.

The control unit, at initial driving, generates corrected picture data corresponding to raw RGB picture data fed from the outside while storing the corrected picture data into a predetermined memory. After the initial driving, upon receipt of raw RGB picture data from the outside, the control unit extracts corrected picture data corresponding to the raw RGB picture data from the memory while transmitting the extracted picture data to the data driver, and generates timing signals for controlling the operation of the scan driver and the data driver while outputting the generated timing signals to the scan driver and the data driver, respectively.

According to still another aspect of the present invention, the liquid crystal display includes a layer of liquid crystal with a predetermined property, a plurality of gate lines, a plurality of data lines crossing over the gate lines while being insulated from the gate lines, and pixels surrounded by the gate and data lines each with a switching circuit connected to the corresponding gate and data lines. The pixels are arranged in a matrix form.

In a method of driving the liquid crystal display, scanning signals are sequentially transmitted to the gate lines (the (a) step).

Upon receipt of RGB gray scale data for displaying picture images from the outside, RGB gammas are established based on the RGB gray scale data, and data voltages are generated based on the established RGB gammas (the (b) step).

The data voltages generated at the (b) step are fed to the data lines (the (c) step.

The (b) step is made through the sub-steps of (b-1) establishing a predetermined imaginative gamma curve, (b-2) at initial driving, receiving raw RGB picture data adapted to RGB gamma curves from the outside, and detecting light transmissions corresponding to grays of the raw picture data over the imaginative gamma curve, (b-3) detecting gray values of the raw picture data corresponding to the detected light transmissions from the relevant gamma curves, and (b-4) transforming the gray values detected at the (b-3) step into a predetermined number of bits, and storing the bit-transformed gray values.

The (b) step further includes the sub-steps of (b-5) after the initial driving, receiving raw picture data adapted to a predetermined gamma curve from the outside, and detecting the stored bit-transformed gray values, and (b-6) transforming the detected gray values into multi-gray scales, and generating data voltages for the data lines.

In the above structure, the raw RGB picture data fed from the outside are controlled in a separate manner while representing the RGB gamma curves with one curve, thereby securing stability in the color sensation and the color temperature.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

The color temperature of grays is determined by the color coordinate of red (R), green (G) and blue (B), and the luminance thereof. Therefore, in case the gamma curves are varied per the respective RGB colors, the grays are varied but the color coordinates of the white grays do not suffer serious variation with a constant color temperature.

In order to lower the color temperature, the gamma curve of blue (B) is lowered while heightening the gamma curve of red (R). It is preferable that the blue (B) transmits the value lower than the data practically input from the outside to the driving IC, and the red (R) transmits the value higher than the input data to the driving IC.

Figure 1:
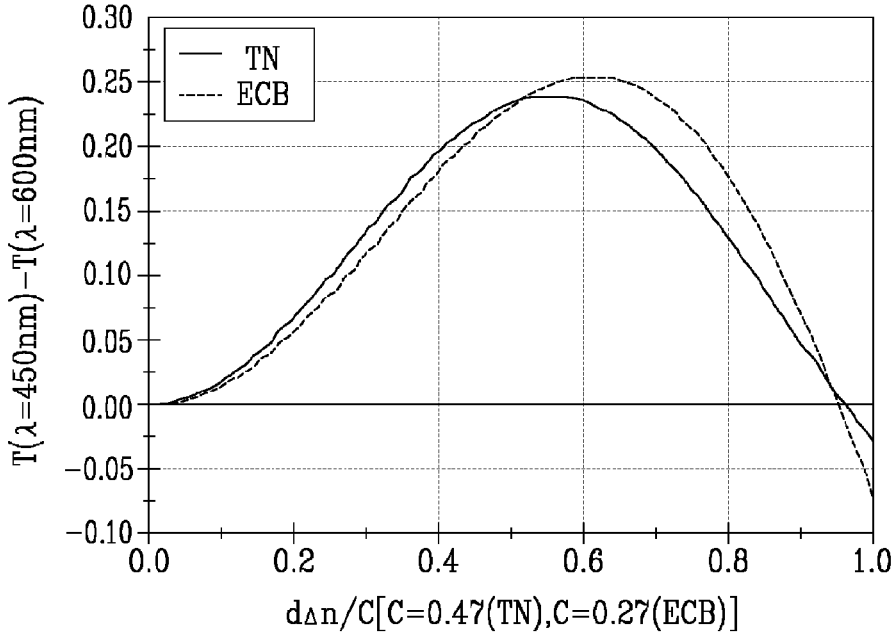
FIG.1(Prior Art)
FIG. 1 is a graph illustrating the difference in light transmission at wavelengths of 450 nm and 600 nm as a function of Δnd in TN and ECB modes.
Figure 2:
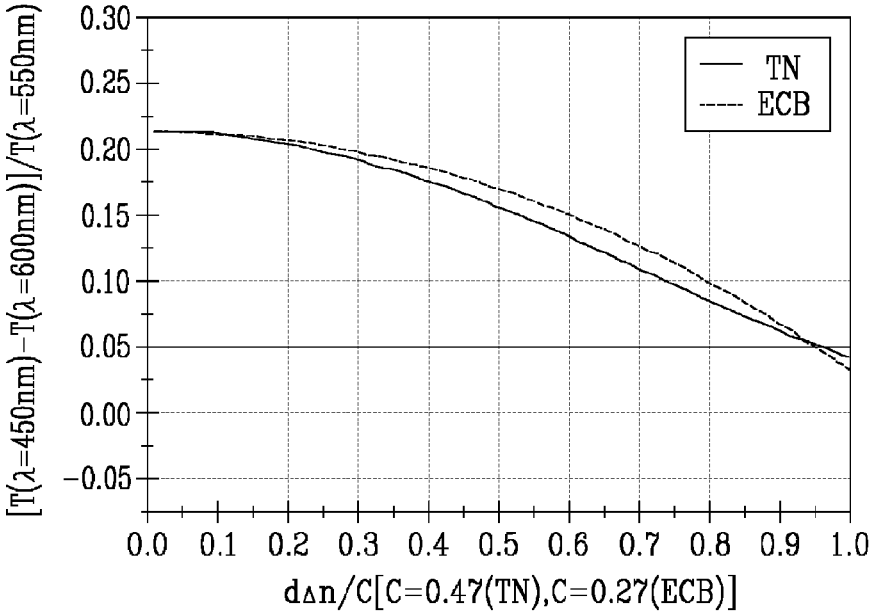
FIG.2(Prior Art)
FIG. 2 is a graph illustrating the values where the graph values illustrated in FIG. 1 are divided by the light transmission.
Figure 3A:
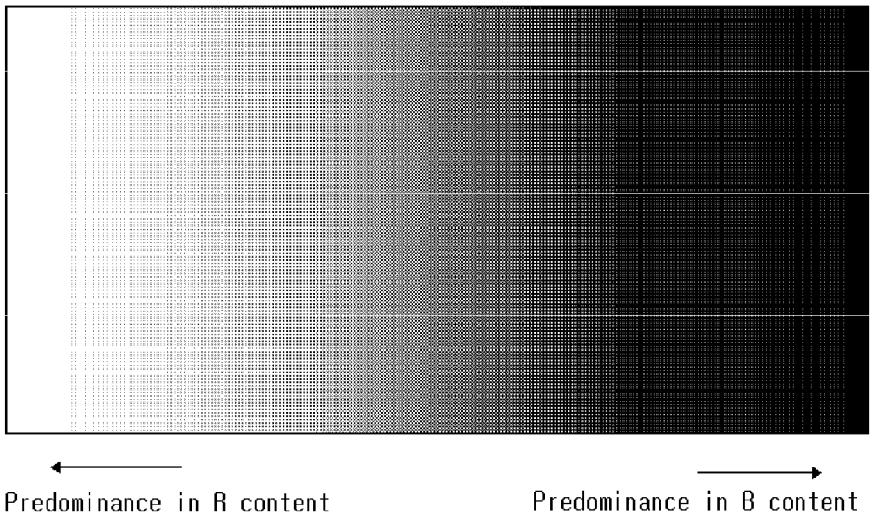
FIG.3A(Prior Art)
FIGS. 3A and 3B illustrate the color sensations pursuant to gray patterns in a usual liquid crystal display.
Figure 3B:
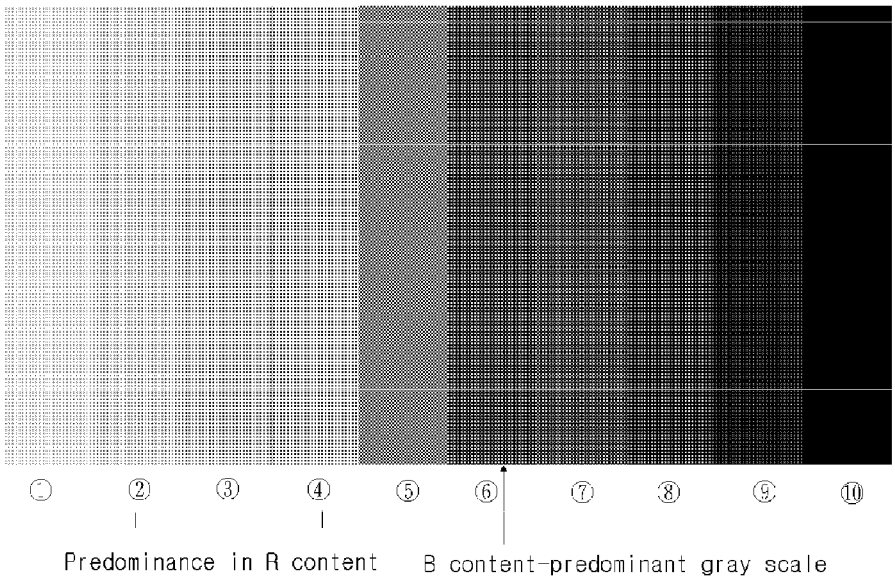
FIG.3B(Prior Art)
Figure 4:
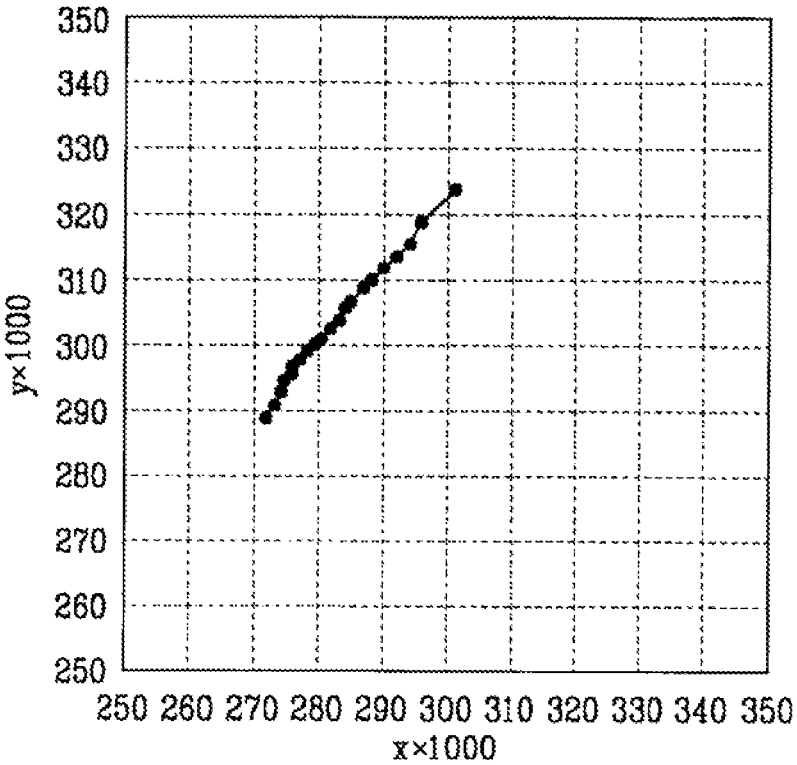
FIG.4 PRIOR ART
FIG. 4 illustrates the variation in color coordinates per white grays in a usual PVA mode liquid crystal display.
Figure 5:
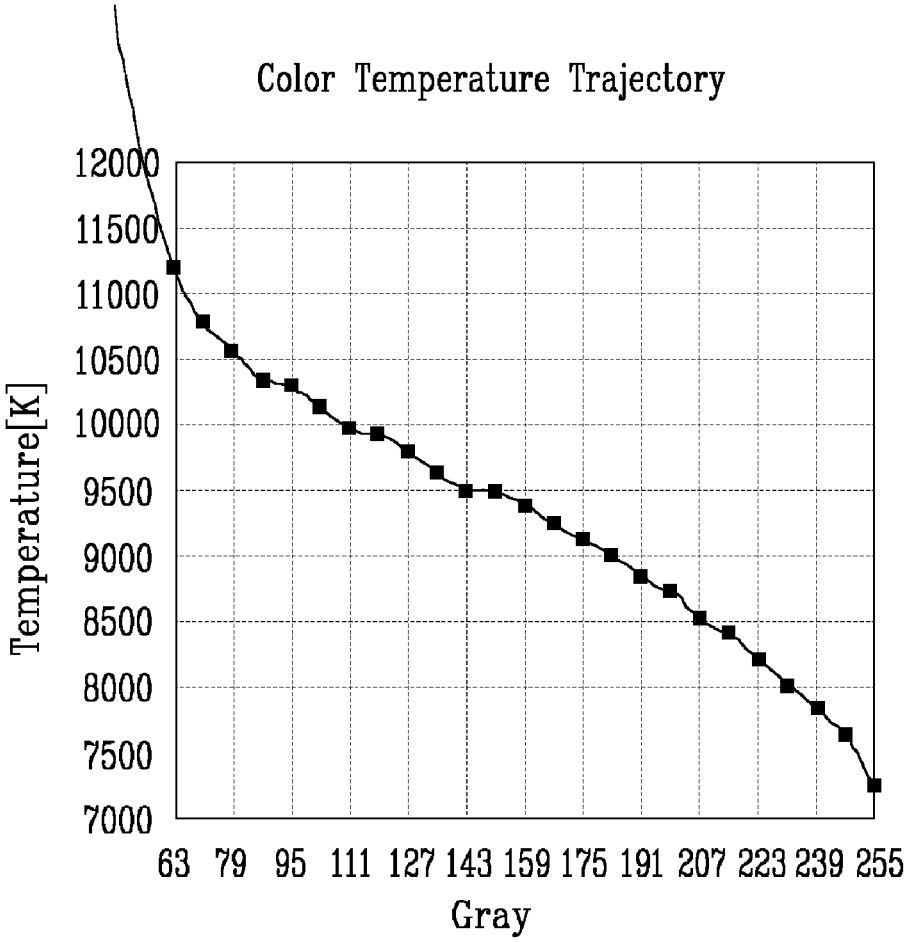
FIG.5(Prior Art)
FIG. 5 is a graph illustrating the color temperature as a function of gray in the PVA mode.
Figure 6:
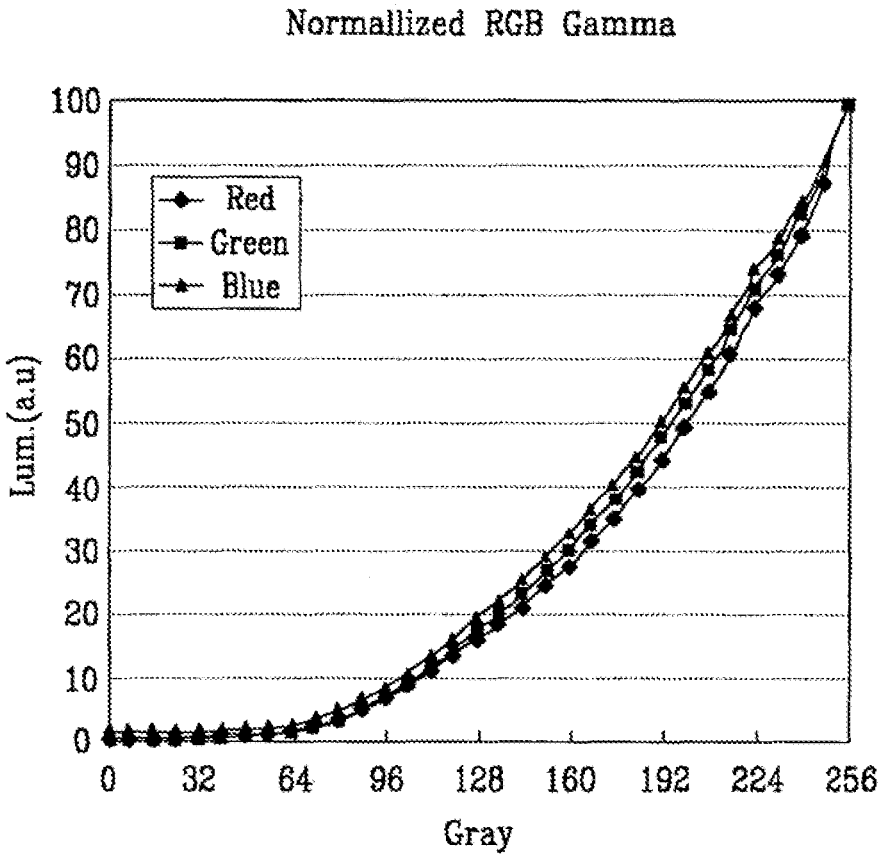
FIG.6 PRIOR ART
FIG. 6 is a graph illustrating RGB gamma curves as a function of grays.
Figure 7:
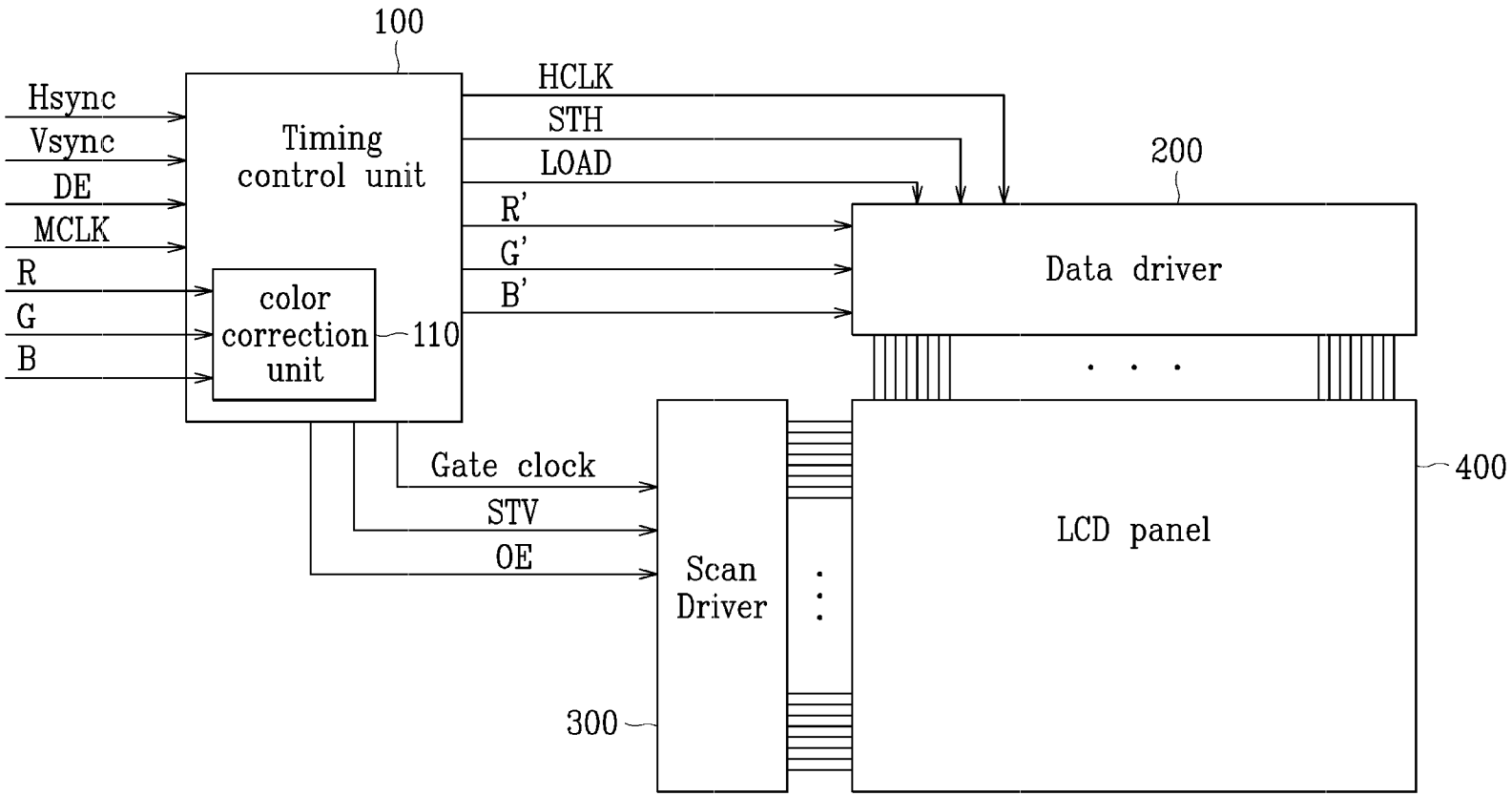
FIG. 7. is a block diagram of a liquid crystal display according to a preferred embodiment of the present invention.

FIG. 7 is a block diagram of a liquid crystal display bearing a color correction function according to a preferred embodiment of the present invention.

As shown in FIG. 7, the liquid crystal display includes a timing control unit 200 with a built-in color correction unit 110, a data driver 200, a scan driver 300, and an LCD panel 400.

The timing control unit 100 with a built-in color correction unit 110 receives RGB picture signals, synchronization signals Hsync and Vsync, and clock signals DE and MCLK from an external graphic controller (not shown), and outputs the color-corrected RGB picture signals to the data driver 200. Furthermore, the timing control unit 100 generates digitalized timing signals for driving the data driver 200 and the scan driver 300, and outputs them to the relevant drivers 200 and 300

Specifically, the timing control unit 100 outputs a horizontal clock signal HCLK, a horizontal synchronization start signal STH and a load signal LOAD or TP to the data driver 200. The HCLK signal makes data shift at the data driver 200. The STH signal instructs to analog-transform the data at the data driver 200, and apply the transformed analog value to the LCD panel 400. The LOAD or TP signal instructs to load the data signal onto the data driver 200.

Furthermore, the timing control unit 100 outputs a gate clock signal Gate clock, a vertical synchronization start signal STV, and an output enable signal OE to the scan driver 300.

The Gate clock signal is to establish the cycle of gate on signals applied to the gate line. The STV instructs to start the gate on signal. The OE signal is to enable the output of the scan driver 300.

Meanwhile, the color correction unit 110 receives raw RGB picture data from an external graphic controller (not shown) after the initial driving while generating and storing corrected picture data corresponding to the raw RGB picture data, and upon receipt of raw RGB picture data from the outside, outputs the corrected picture data corresponding to the raw RGB picture data after the initial driving.

Specifically, at the initial driving, the color correction unit 110 receives raw RGB picture data of a predetermined number of bits from the outside, and transforms them into corrected picture data of a predetermined number of bits while storing them.

Furthermore, after the initial driving, the color correction unit 110 receives raw RGB picture data from the outside, and extracts the corrected picture data corresponding to the raw picture data. The color correction unit 110 transforms the extracted picture data into multi-gray scales, and outputs the transformed data. The number of bits of the corrected picture data before the multi-gray scale transformation may be the same as or greater than the bit number of the raw picture data. It is preferable that the number of bits of the corrected picture data after the multi-gray scale transformation should be the same as the bit number of the raw picture data.

In case the liquid crystal display is formed with an analog type, an A/D converter may be provided to convert the analog raw picture data into digital raw picture data.

The color correction unit 110 may be positioned externally to the timing control unit 100.

The data driver 200 receives RGB digital data R[0:N], G[0:N] and B[0:N] from the timing control unit 100 while storing them. When the load signal LOAD is applied to the data driver 200 to instruct loading of the data to the LCD panel 400, the data driver 200 selects voltages corresponding to the respective digital data, and transmits the data voltages V1 to Vn (not shown) to the LCD panel 400.

Furthermore, the data driver 200 outputs the data voltages V1 to Vn to the LCD panel 400 such that the pixels arranged at the LCD panel 400 bear a polarity inverted per each frame. This polarity inversion is due to the usual property of the liquid crystal.

The scan driver 300 is provided with a shift resistor, a level shifter, and a buffer. The scan driver 300 receives a gate clock signal Gate clock and a vertical line start signal STV from the timing control unit 100, and voltages Von, Voff and Vcom (not shown) from a gate driving voltage generation unit (not shown) or the timing control unit 100. The scan driver 300 opens passage of the voltages to the correct pixels at the LCD panel 400.

The LCD panel 400 includes n numbers of data lines, m numbers of gate lines arranged perpendicular to the data lines, and pixel electrodes placed at the cross regions of the data and the gate lines in a matrix form. The one end of the pixel electrode is connected to the gate line, and the opposite end of the pixel electrode is connected to the data line. As the gate voltages G1 to Gn (not shown) are applied to the corresponding pixels from the scan driver 300, the LCD panel 400 drives the built-in pixel electrodes in response to the data voltages D1 to Dm (not shown) from the data driver 200.

Alternatively, at the initial driving, the corrected picture data optimally adapted to the LCD panel and stored may be output instead of the raw picture data.

Figure 8:
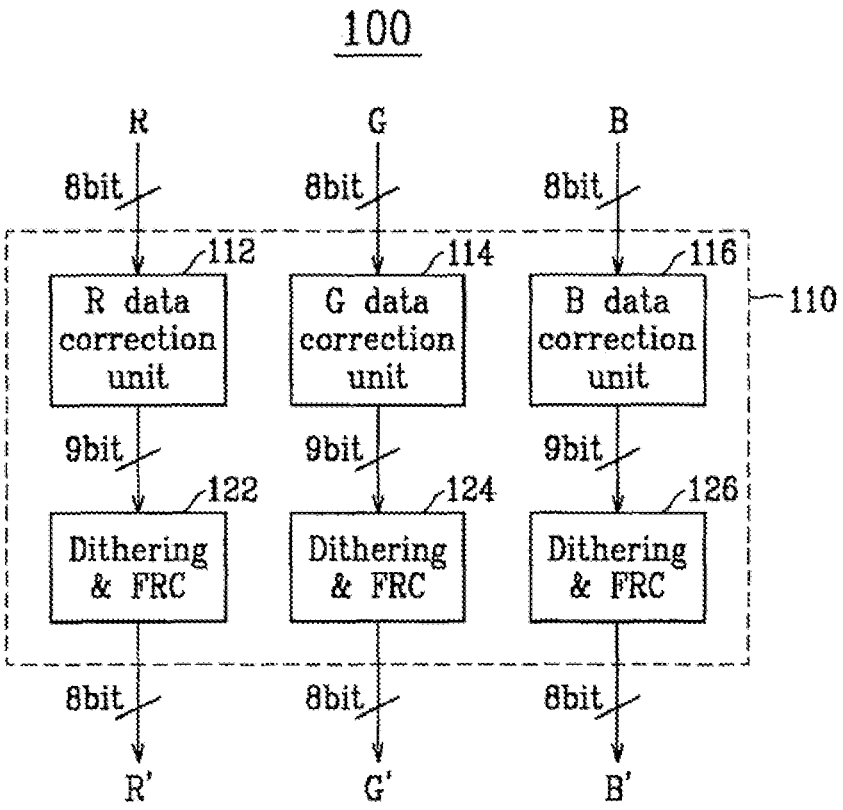
FIG. 8 is a block diagram of a color correction unit for the liquid crystal display shown in FIG. 7.

FIG. 8 conceptually illustrates the color correction unit for the liquid crystal display shown in FIG. 7.

As shown in FIG. 8, the color correction unit includes RGB data correction units 112, 114 and 116, and first to third multi-gray scale units 122, 124 and 126.

In operation, upon receipt of raw RGB picture data of each 8 bits from the outside, the RGB data correction units 112, 114 and 116 transform them into predetermined data of each 9 bits while being adapted to the characteristic of the liquid crystal, and output the data to the first to third multi-gray scale units 122, 124 and 126. The first to third multi-gray scale units 122, 124 and 126 transform the received data into corrected RGB picture data of each 8 bits, and output them to the timing control unit 200. It is preferable that the multi-gray scale units 122, 124 and 126 should spatially and temporarily make the treatments of dithering and frame rate control (FRC).

The treatments of dithering and FRC will be now briefly explained.

In the usual liquid crystal display, a way of FRC is used to express gray levels. That is, a pixel at one frame that can be expressed at the LCD panel can be represented as a two-dimensional plane of X and Y where X indicates the number of horizontal lines, and Y indicates the number of vertical lines. When the variable at the timing axis indicating the number of frames is established to be Z, the coordinate value for the pixel location at one position can be expressed as a three-dimensional value of X, Y and Z.

The duty rate is defined as the pixel-on numbers divided by the predetermined frame numbers where X and Y are fixed at a predetermined value, and the predetermined frames are repeated. In case the duty rate at a certain gray level is assumed to be ½ at the position (1, 1) of the LCD frame, the pixel is in an on state at the (1, 1) position for one frame at two frames. Therefore, in order to express gray levels in the liquid crystal display, a duty rate should be established per each gray level, and the pixel turns on or off in accordance with the established duty rate.

Such a technique of turning on or off the pixel is called the "FRC."

However, in case the LCD is driven only through the FRC, it is possible that the neighboring pixels simultaneously turn on or off. When the neighboring pixels turn on or off, a flicker phenomenon where the screen is visually flickered is generated.

In order to eradicate the flicker phenomenon, a way of dithering is used. The dithering refers to a way where even though the neighboring pixels are simultaneously placed at the same gray level, they are controlled to have different on/off values in accordance with the pixel locations such as frame, vertical line, or the horizontal line.

Figure 9:
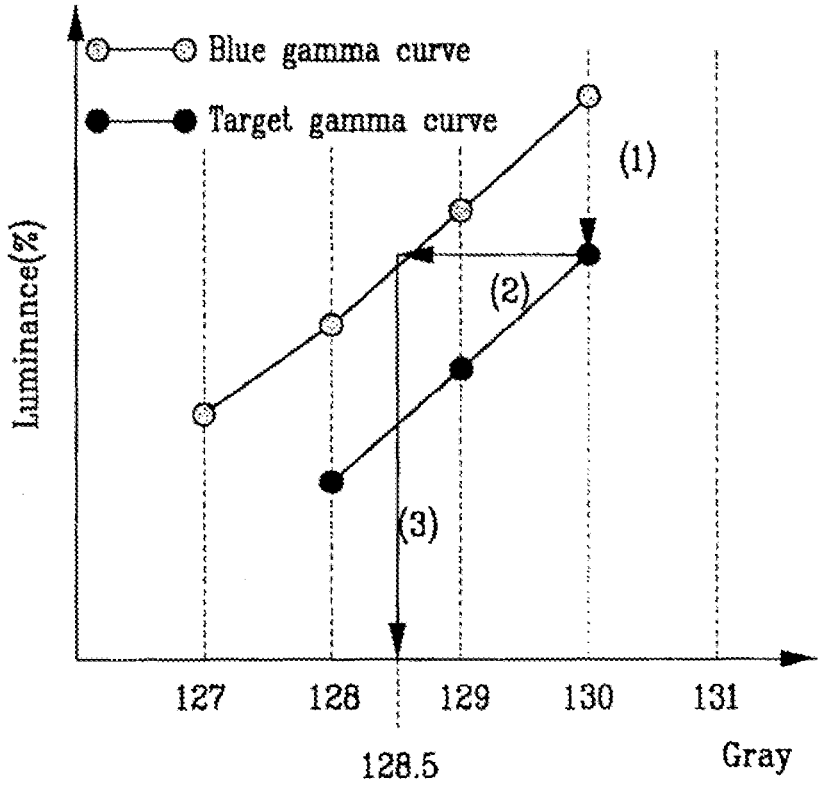
FIG. 9 schematically illustrates the way of varying the B gamma curve into a target gamma curve.

FIG. 9 illustrates the way of converting the B gamma curve into a target gamma curve.

As shown in FIG. 9, when it is intended to convert the B gamma curve into a target gamma curve, for instance when it is intended to lower 130 gray luminance into a target gamma curve, the following steps are made.

First, upon receipt of raw picture data, for example, of B data with 130 gray information, the luminance of the target gamma curve corresponding to the 130 gray is found (Step 1).

Thereafter, the point of the original B gamma curve corresponding to the relevant luminance found over the target gamma curve is found (Step 2). In case the corresponding point (that is, the luminance) is not present over the B gamma curve, the value of B gray is found through a predetermined interpolation process. Particularly, such an interpolation process will be made when the picture data are input at low gray scales.

Thereafter, the gray value of the relevant corresponding point is found (Step 3). As shown in FIG. 9, the value found through the above steps turns out to be 128.5. The value of 128.5 cannot be expressed with the conventional data of 8 bits. Therefore, it is necessary to extend the range of grays. That is, 9 bits or more of corresponding values that can express gray values above 8 bits are required. The 9 bits can express 512 numbers of grays. In this way, the color correction effects can be significantly enhanced.

Therefore, 9 bits of information of B data corresponding to 256 numbers of grays can be found, and changed. In relation to the changed 9 bits, the liquid crystal display can display smoothly through the ways of spatial dithering and temporal frame rate control.

As shown in FIG. 9, the B gamma curve is changed while establishing a predetermined target gamma curve. It is also possible that the G gamma curve is established to be a target gamma curve, and the B gamma curve is approximated to the G gamma curve.

Furthermore, in the above method, the 9 bits of value corresponding to the 8 bits of R gamma curve can be found in synchronization with the target gamma curve or the determined G gamma curve.

Figure 10:
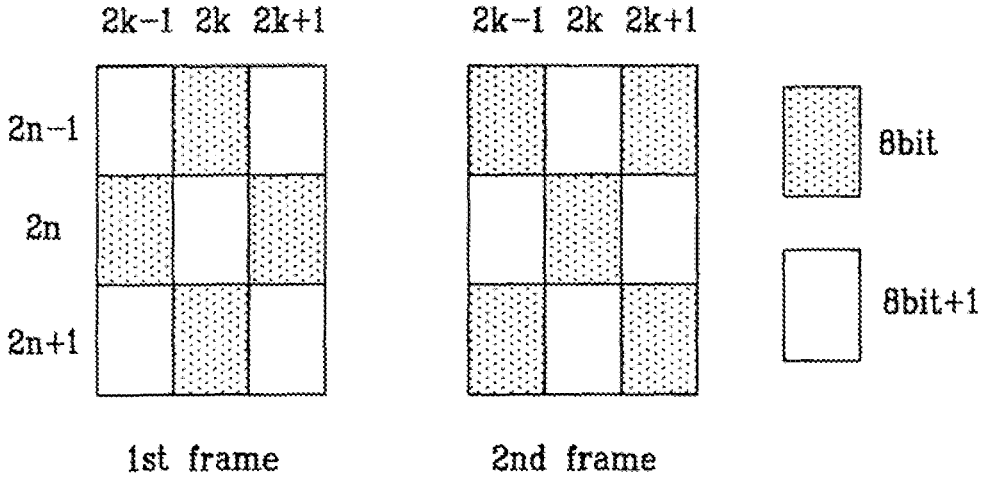
FIG. 10 illustrates the dithering/FRC treatment of expressing the 9 bit data with 8 bit data.

FIG. 10 illustrates the dithering/FRC of expressing the 9 bits of data with 8 bits of data.

In case the bottom most bit among the 9 bits of data is "1," if the upper values of 8 bits are directly sent depending upon where the upper 8 bits of data are placed or what numbered frame the 8 bits of data are, or sent with the addition of the "1", the sensual difference is not made at the display screen.

In this way, the desired gamma control is made with respect to the respective RGB data. When the RGB gamma curves are measured, the corrected gamma curve of blue (B) is established to be lower than the raw gamma curve of blue (B), and the raw gamma curve of red (R) is established to be higher than the raw gamma curve of red (R).

Figure 11:
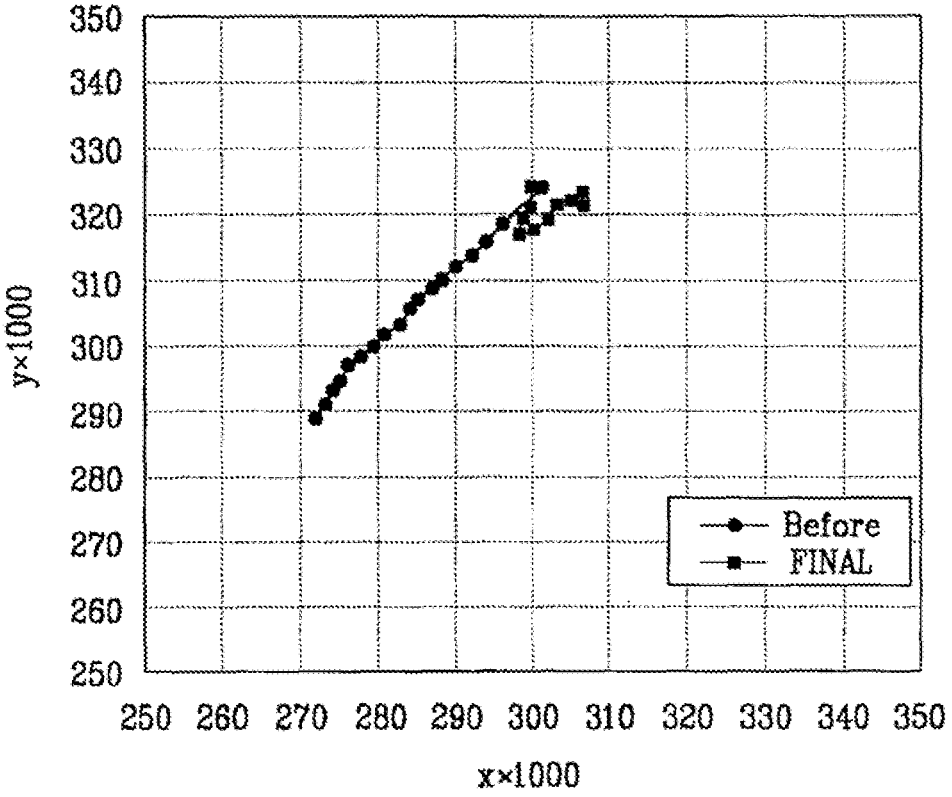
FIG. 11 is a graph illustrating the curves of measuring the movement of color coordinates with or without the color correction.
Figure 12:
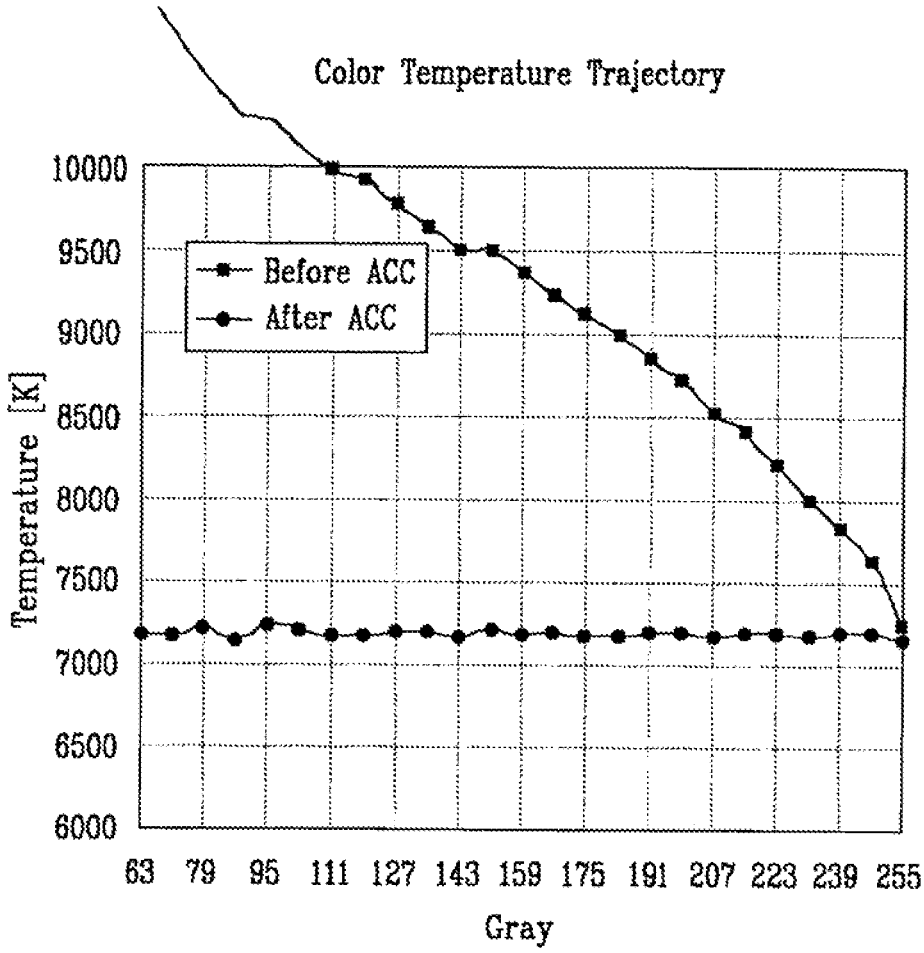
FIG. 12 is a graph illustrating the curves of measuring the color temperature with or without the color correction.

Variation in the color coordinates and the color temperature with the controlled gamma curves is illustrated in FIGS. 11 and 12.

FIG. 11 is a graph illustrating the curves of measuring the movement of color coordinates with or without the adaptive color correction, and FIG. 12 is a graph illustrating the curves of measuring the color temperature with or without the adaptive color correction.

As shown in FIGS. 11 and 12, the movement degree in the color coordinates with the presence of the adaptive color correction is significantly reduced compared to that without the adaptive color correction, and the color temperature is kept to be constant with the adaptive color correction while rapidly elevated without the adaptive color correction.

Figure 13:
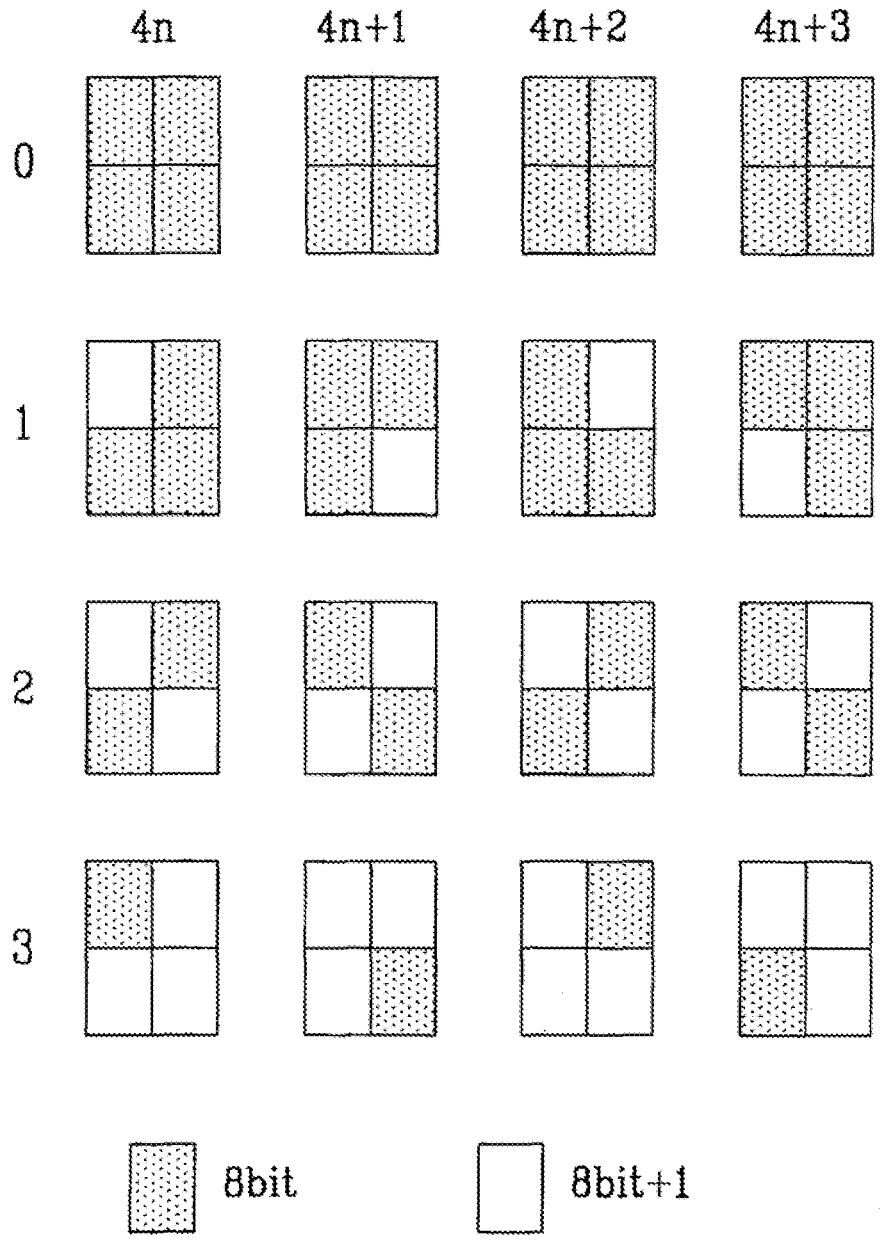
FIG. 13 illustrates the dithering/FRC treatment of expressing the 10 bit data with 8 bit data.

In case 10 bits of data are used instead of the 9 bits of data, the dithering/FRC is applied in the same way as in FIG. 13, and the same result is obtained.

FIG. 13 illustrates the dithering/FRC treatments of expressing the 10 bits of data with 8 bits. Table 1 indicates the relation of one-to-one transformation of the 10 bits with respect to the 8 bits, and the FRC corresponding thereto.

TABLE 1

| Input | | Output | | | | | | |
|---|---|---|---|---|---|---|---|---|
| Decimal | Hexadecimal | Decimal | | | FRC | | | |
| (10) scale | (16) scale | (10) scale | Top 8 bits | Bottom 2 bits | First frame | Second frame | Third frame | Fourth frame |
| $146_{10}$ | $92_{16}$ | $557_{10}$ | $8B_{16}$ | 01 | $8C_{16}$ | $8B_{16}$ | $8B_{16}$ | $8B_{16}$ |
| $147_{10}$ | $93_{16}$ | $561_{10}$ | $8C_{16}$ | 01 | $8D_{16}$ | $8C_{16}$ | $8C_{16}$ | $8C_{16}$ |
| $148_{10}$ | $94_{16}$ | $565_{16}$ | $8D_{16}$ | 01 | $8E_{16}$ | $8D_{16}$ | $8D_{16}$ | $8D_{16}$ |
| $149_{10}$ | $95_{16}$ | $570_{10}$ | $8E_{16}$ | 10 | $8F_{16}$ | $8F_{16}$ | $8E_{16}$ | $8E_{16}$ |
| $150_{10}$ | $96_{16}$ | $574_{10}$ | $8F_{16}$ | 10 | $90_{16}$ | $90_{16}$ | $8F_{16}$ | $8F_{16}$ |

As listed in Table 1, upon receipt of 8 bits of raw picture data from the outside, the data is transformed into 10 bits through data extension and memorized. Then, in case 8 bits of raw picture data are input from the outside, the stored 10 bits of corrected picture data is called upon, and output.

Even though 10 bits of data are output, the display can be made substantially only with 8 bits through the FRC way shown in FIG. 13.

As described above, 10 bits of corrected picture data corresponding to the 8 bits of raw picture data are obtained to control the gamma curve, but this is not limited to the 8 bits or the 10 bits. That is, 8 bits of corrected picture data corresponding to the 6 bits of raw picture data may be obtained to control the gamma curve.

Furthermore, 8 bits of corrected picture data corresponding to the 8 bits of raw picture data may be obtained to control the gamma curve.

The 8 to 8 bit transformation process will be briefly explained.

First, the most approximate 8 bits of data but not 10 bits should be found. The 8 bits of data are transmitted to the data driver through the FRC way. The FRC way based on the 10 bits is realized by the bottom 2 bits of the input data.

Table 2 indicates the one to one transformation of the 8 bits to the new 8 bits, and the FRC corresponding thereto.

TABLE 2

| Input | | Output | | | | | | |
|---|---|---|---|---|---|---|---|---|
| Decimal | Hexadecimal | Decimal | | | FRC | | | |
| (10) scale | (16) scale | (10) scale | Top 8 bits | Bottom 2 bits | First frame | Second frame | Third frame | Fourth frame |
| $146_{10}$ | $92_{16}$ | 10 | $139_{16}$ | $8B_{16}$ | $8C_{16}$ | $8C_{16}$ | $8B_{16}$ | $8B_{16}$ |
| $147_{10}$ | $93_{16}$ | 11 | $140_{10}$ | $8C_{16}$ | $8D_{16}$ | $8D_{16}$ | $8D_{16}$ | $8C_{16}$ |

TABLE 2-continued

| Input | | Output | | | | | | |
|---|---|---|---|---|---|---|---|---|
| Decimal | Hexadecimal | Decimal | | | FRC | | | |
| (10) scale | (16) scale | (10) scale | Top 8 bits | Bottom 2 bits | First frame | Second frame | Third frame | Fourth frame |
| $148_{10}$ | $94_{16}$ | 00 | $141_{10}$ | $8D_{16}$ | $8D_{16}$ | $8D_{16}$ | $8D_{16}$ | $8D_{16}$ |
| $149_{10}$ | $95_{16}$ | 01 | $143_{10}$ | $8F_{16}$ | $90_{16}$ | $8F_{16}$ | $8F_{16}$ | $8F_{16}$ |
| $150_{10}$ | $96_{16}$ | 10 | $144_{10}$ | $90_{16}$ | $91_{16}$ | $91_{16}$ | $90_{16}$ | $90_{16}$ |

Table 3 illustrates the difference between the transformation of 8 to 10 bits and the transformation of 8 to 8 bits.

TABLE 3

| Input | 146 | 147 | 148 | 149 | 150 |
|---|---|---|---|---|---|
| 10 bits | 8B-01 | 8C-01 | 8D-01 | 8E-10 | 8F-10 |
| 8 bits | 8B-10 | 8C-11 | 8D-00 | 8F-01 | 90-10 |
| Difference | +1 | +2 | −1 | +2 | +4 |

As known from Table 3, the 8 to 8 bit transformation involves a rough gamma curve compared to the 8 to 10 bit transformation.

Meanwhile, the former transformation involves reduced memory usage because it uses relatively small numbers of bits. If such a curve does not influence visibility in any significant manner, it can be applied in an appropriate manner.

In case the final output to the driving IC is 6 bits, the top 6 bits and the bottom 3 bits are divided, and suffer the dithering/FRC treatment. As the dithering/FRC treatment is made with the bottom 3 bits, a time frame of $8(2^3)$ is required.

Figure 14:
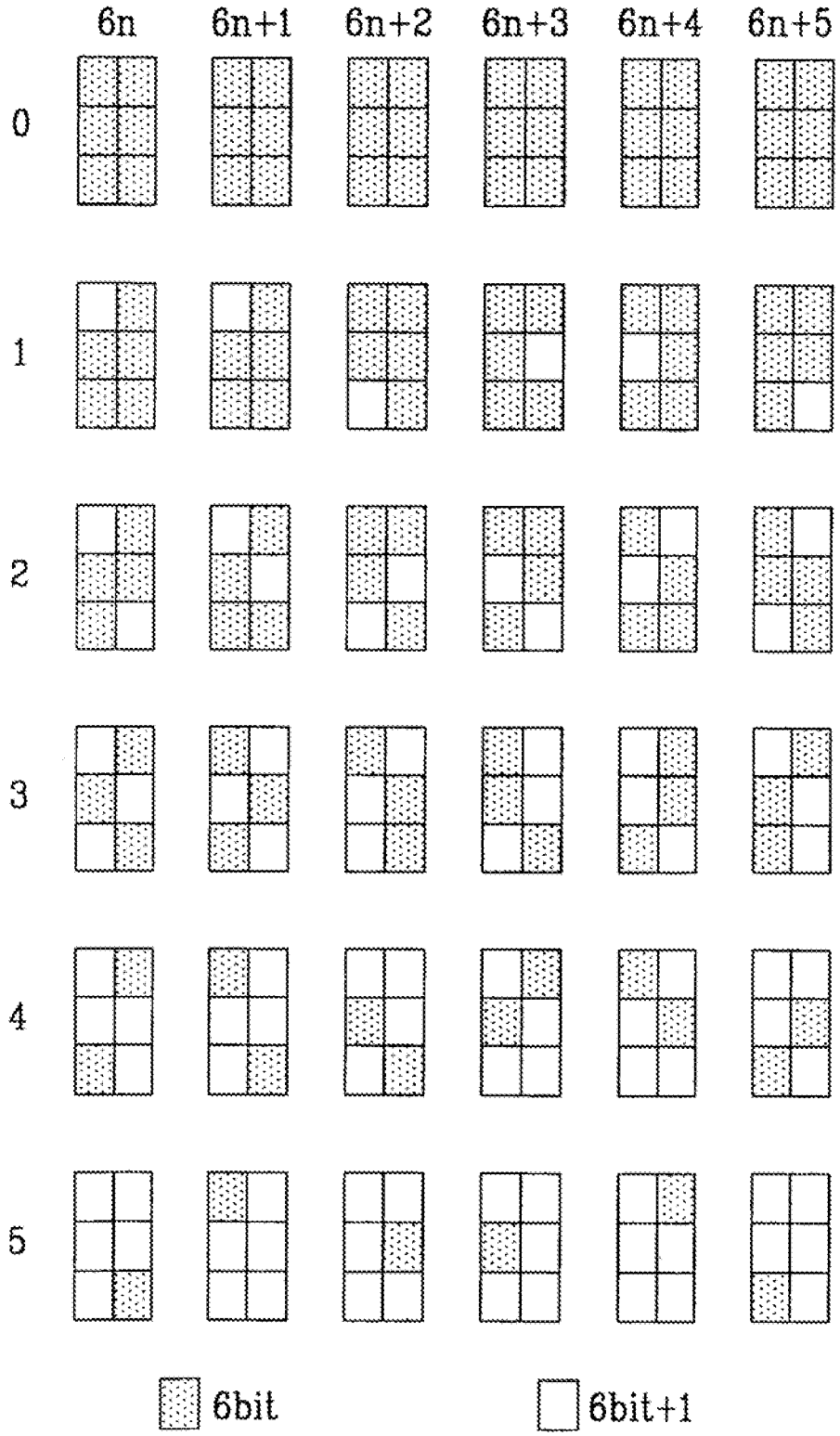
FIG. 14 illustrates the dithering/FRC treatment made for six frames.

Furthermore, in the matter of the response speed of liquid crystal, as shown in FIG. 14, the FRC treatment may be made only for six frames.

FIG. 14 illustrates the dithering/FRC treatments for six frames. In this case, the data are corrected such that the bottom 3 bits have only the numbers of 0 to 5.

Since the values of bottom 3 bits are existent only by 6, the FRC may be made within 6 frames.

Then, as shown in FIG. 9, in case the B gray values for the transmission of the G gray over the B gamma curve are not present, the relevant interpolation process will be now explained in detail.

Figure 15:
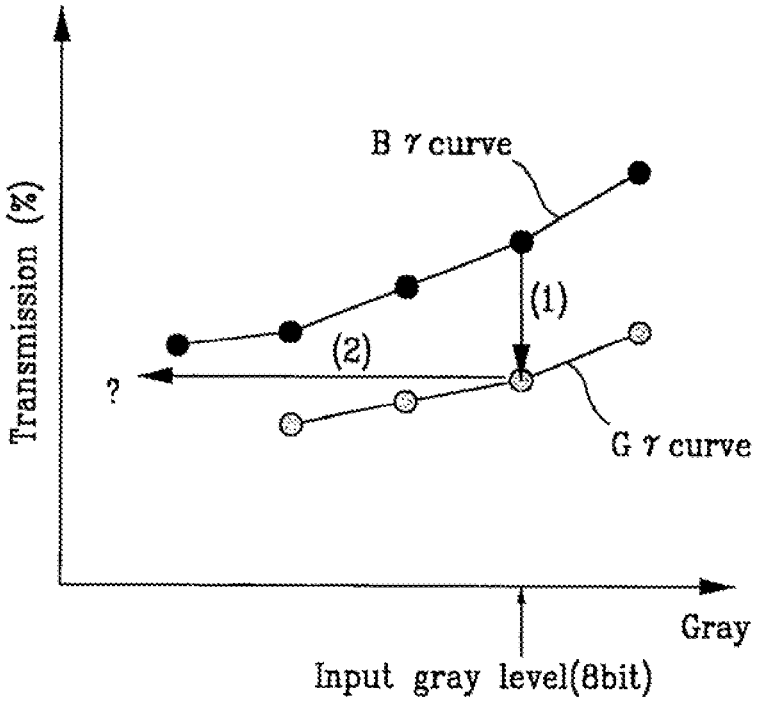
FIG. 15 illustrates the case where the transmission of B is absent in FIG. 9.
Figure 16:
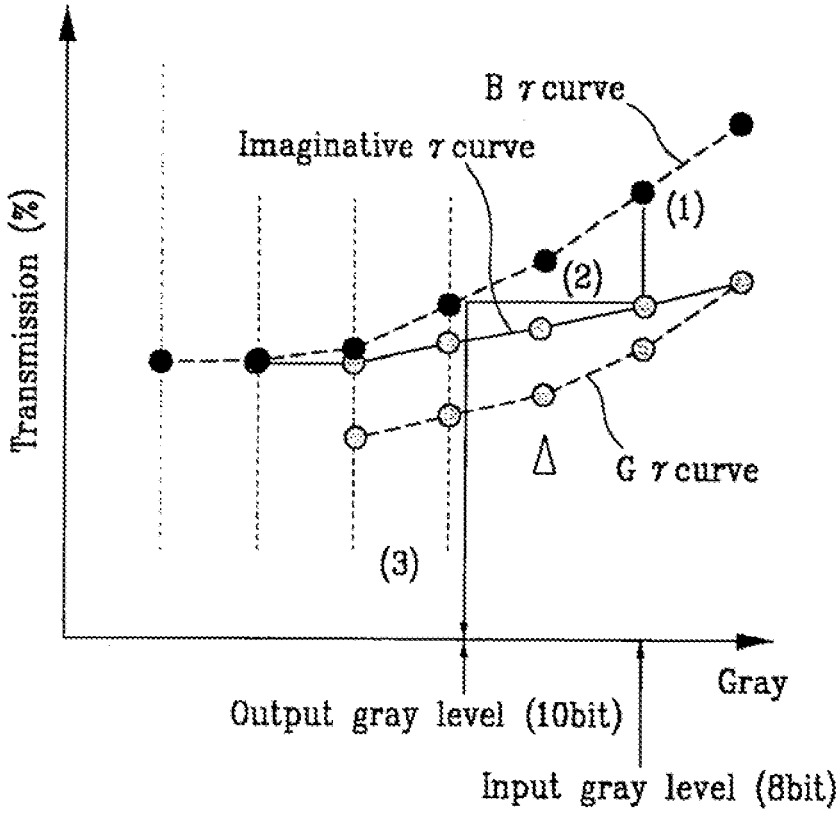
FIG. 16 schematically illustrates the way of generating data in case the correct transmission is absent in FIG. 9.

FIG. 15 illustrates the case where the transmission of the blue (B) is not present in FIG. 9, and FIG. 16 illustrates the way of generating data in that case. Particularly, the situation is that the target gamma curve is established to be a green (G) gamma curve, the raw gray scale data to be 8 bits, and the corrected gray scale data to be 10 bits.

As shown in FIG. 15, in the course of making 10 bits of corrected gray scale data through the transformation from the top gray to the bottom gray, a case of not meeting the B gamma curve is made.

In this case, as shown in FIG. 16, an imaginative curve where the transmission is monotonously reduced from the top gray upper than the relevant gray data (indicated by triangles) to the bottommost gray is made. Thereafter, as shown in FIG. 9, 8 bits of raw picture data is shifted into 10 bits of corrected picture data through the transformation from the top gray to the bottom gray based on the imaginative curve.

The 10 bits data are tabled in a predetermined manner, and stored at a volatile memory. In correspondence to the input raw picture data, the 10 bits of corrected picture data stored at the table are extracted, and output.

The output 10 bits of corrected picture data are FRC-treated based on the bottom 2 bits. Upon transmission of 8 bits data to the data driver, RGB gamma curves agree to each other, thereby obtaining high quality display. If color sensation is generated pursuant to relevant grays only with one agreed-upon curve, the gamma curve of the relevant color is lowered to eradicate the color sensation, or the gamma curve of other colors is heightened, thereby finding the optimum corrected picture data.

Of course, the 8 bits of raw picture data may be transformed into 9 bits of corrected picture data.

The overall way of driving will be now explained in detail.

Particularly, only the case where the final output of the timing control unit is 8 bits will be described because the 6 bits output uses only the corresponding dithering/FRC block.

Figure 17:
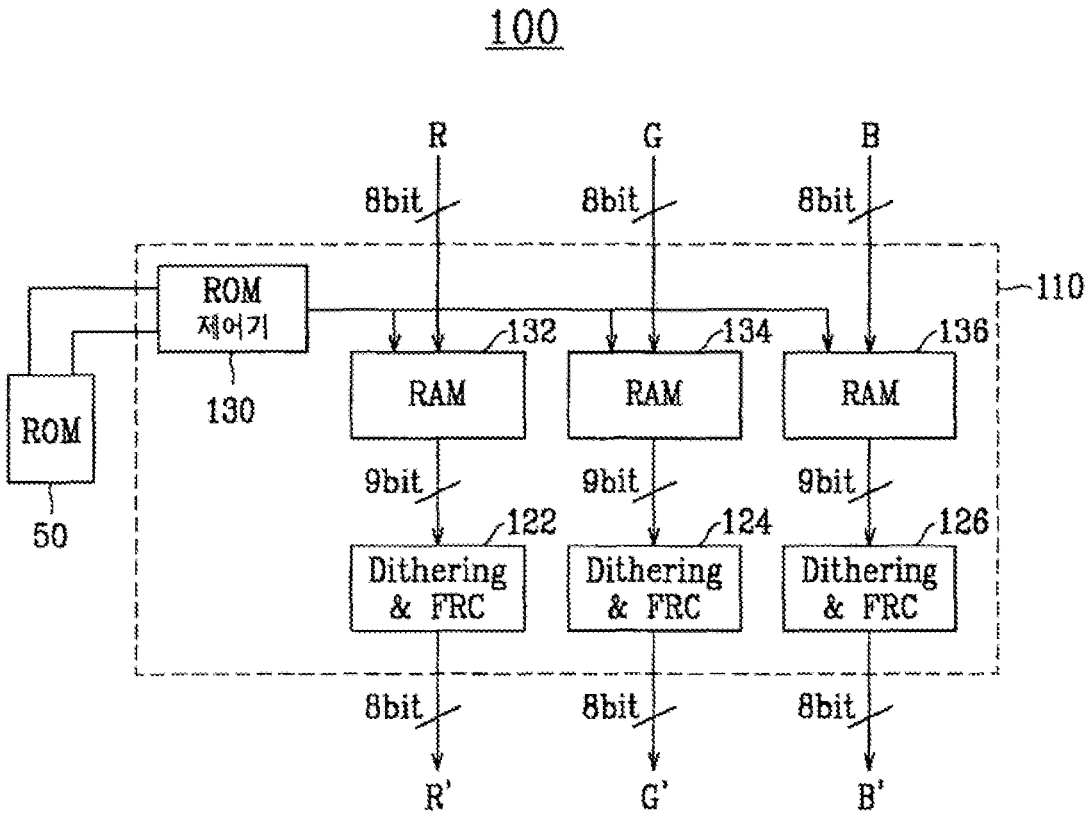
FIG. 17 is a block diagram of a color correction unit for a liquid crystal display according to a first preferred embodiment of the present invention.

FIG. 17 illustrates the color correction unit according to a first preferred embodiment of the present invention bearing the circuit structure where the extended data are stored at an external memory.

As shown in FIG. 17, the color correction unit includes a ROM control unit 130, a first RAM 132, a second RAM 134, a third RAM 136, a first multi-gray scale unit 122, a second multi-gray scale unit 124, and a third multi-gray scale unit 126.

The first to third RAMs 132, 134 and 136 store the corrected picture data corresponding to the raw picture data fed from the outside in a predetermined look-up table LUT form. In accordance with the output request of the corrected picture data corresponding to the raw picture data, the relevant corrected picture data are extracted, and fed to the required place.

In operation, when the extended data optimally controlled according to the liquid crystal characteristics are stored at the outside of the color correction unit 100, the color correction unit 100 reads the extended data from the external ROM 50 at an initial time, and stores data in the internal RAMs 132, 134 and 136.

After storage of all the data, the digital picture image data input from the external component such as a graphic controller are sent to the multi-gray scale units 122, 124 and 126 that make the treatment of dithering/FRC with respect to the extended data of 9 bits being the address of RAMs 132, 134 and 136. They are finally output to the data driver 200 via the timing control unit 100.

Of course, it is also possible that upon receipt of n bits of data, they are extended to n or more bits of data, and suffer the dithering/FRC treatment, thereby outputting the n bits of data.

In the circuit structure of the color correction unit, the extended data are stored at the external ROM 50. Therefore, even if the liquid crystal panel is altered, only the value of ROM storing the extended data optimally adapted to the altered liquid crystal panel can be changed to cope with the alteration.

Figure 18:
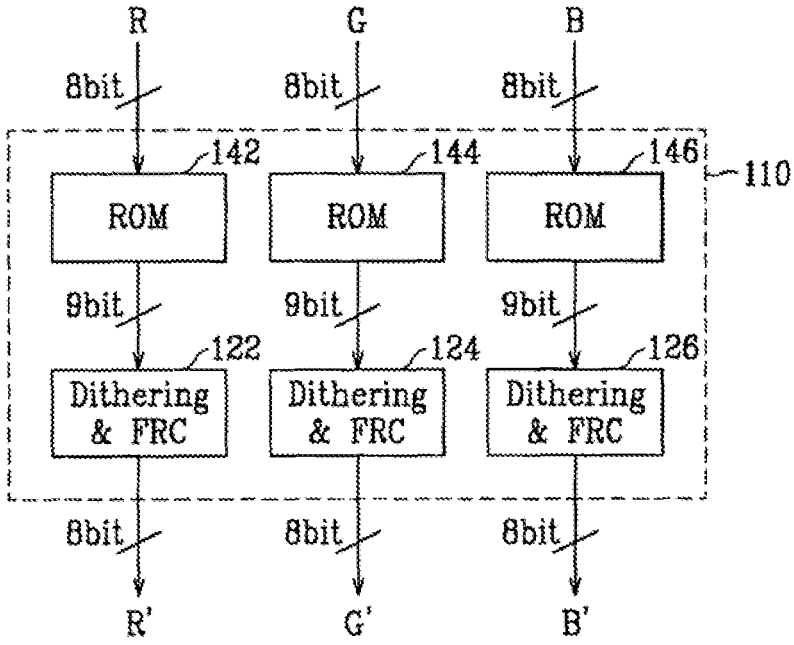
FIG. 18 is a block diagram of a color correction unit for a liquid crystal display according to a second preferred embodiment of the present invention.

FIG. 18 illustrates a color correction unit according to a second preferred embodiment of the present invention where the extended data are stored at the internal ROM.

As shown in FIG. 18, the color correction unit includes a first ROM 142, a second ROM 144, a third ROM 146, a first multi-gray scale unit 122, a second multi-gray scale unit 124, and a third multi-gray scale unit 126.

If the speed of reading the internal ROM is enough, it is not necessary to use the internal RAM after reading the data from the ROM. Therefore, the external digital picture image data become to be the address of the ROM, and send the extended data of 9 bits corresponding to the input data to the multi-gray scale units 122, 124 and 126 performing the dithering/FRC treatment, finally outputting them to the data driver 200 via the timing control unit 100.

Of course, it is also possible that upon receipt of n bits of data, they are extended to n or more bits of data, and suffer the dithering/FRC treatment, thereby outputting the n bits of data.

Furthermore, it is also possible that the color correction unit may be installed at the rear of the timing control unit.

In the circuit structure of the color correction unit according to the second preferred embodiment of the present invention, a separate additional ROM is not required so that the production cost can be lowered.

Figure 19:
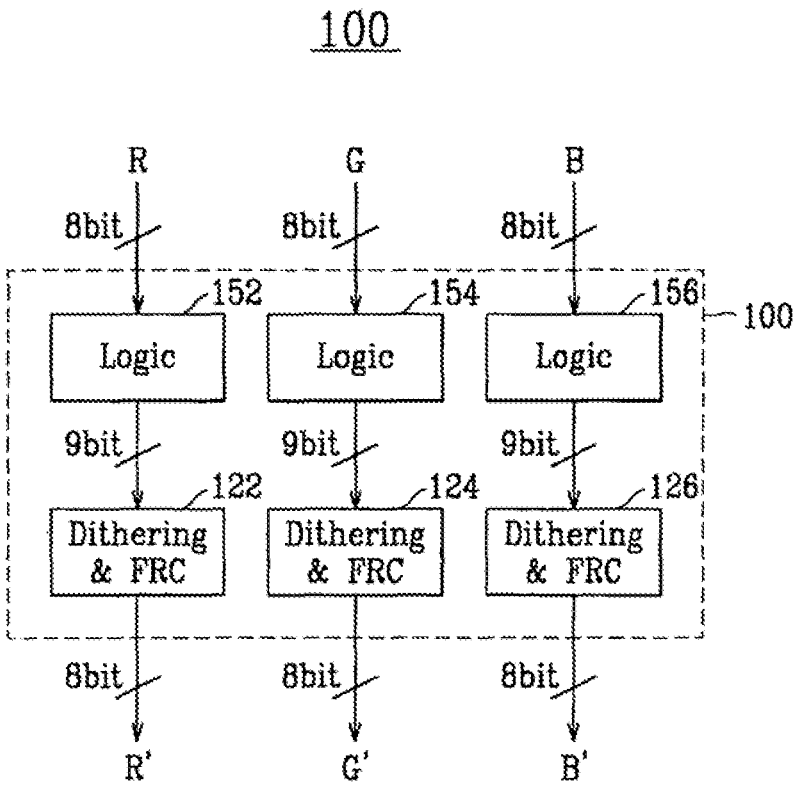
FIG. 19 is a block diagram of a color correction unit for a liquid crystal display according to a third preferred embodiment of the present invention.

FIG. 19 illustrates a color correction unit according to a third preferred embodiment of the present invention where the data are stored using the conventional digital logic.

As shown in FIG. 19, the first to third logics 152, 154 and 156 receive raw picture image data for expressing the RGB gray scales from the outside at initial driving, and generate corrected picture data while storing them at a predetermined volatile memory (not shown). After the initial driving, upon receipt of the RGB raw picture data from the outside, the corrected picture data corresponding to the raw picture data are extracted from the volatile memory to output them to the first to third multi-gray scale units 122, 124 and 126 performing the dithering/FRC treatment.

As described above, upon receipt of RGB raw picture data from the outside, new corrected RGB picture data are generated through bit extension, and stored. The RGB gamma curves with respect to the corrected RGB picture data are controlled so that the problems of difference in color sensation, and radical variation in the color temperature can be solved while reducing the amount of memory usage.

While the present invention has been described in detail with reference to the preferred embodiments, those skilled in the art will appreciate that various modifications and substitutions can be made thereto without departing from the spirit and scope of the present invention as set forth in the appended claims.

The invention claimed is:

1. A liquid crystal display comprising:

a liquid crystal display panel for displaying picture images and having a plurality of pixels respectively representing at least three colors; and a color correction unit configured to receive input picture data representing respective colors;

wherein the color correction unit is configured to refer to a target gamma curve to thereby transform the input picture data of a first color having a first gray value into output picture data of the first color having a second gray value, and wherein the target gamma curve is different from a gamma curve of the first color, wherein the transformed second gray value of the first color has the same luminance as that of a first gray value of the target gamma curve, and wherein the first gray value of the target gamma curve is substantially equal to the first gray value of the first color.

2. The liquid crystal display of claim 1, wherein the input picture data and the output picture data are represented by a plurality of bits.

3. The liquid crystal display of claim 2, wherein a bit number of the input picture data and a bit number of the output picture data are the same or different from each other.

4. The liquid crystal display of claim 3, wherein a portion of the bits of the output picture data is configured to be referred to display a picture via a frame rate control.

5. The liquid crystal display of claim 1, wherein the first color and the second color are selected from red, green, blue and other colors, and the first color and the second color are different from each other.

6. The liquid crystal display of claim 1, further comprising a look-up table, wherein the color correction unit is further configured to refer to the look-up table to transform the input picture data into the output picture data.

7. A liquid crystal display comprising:

a liquid crystal display panel for displaying picture images and having a plurality of pixels respectively representing at least three colors; and a color correction unit configured to receive input picture data representing respective colors and having an established imaginative gamma curve;

wherein the color correction unit is configured to refer to the established imaginative gamma curve and to transform the input picture data of a first color having a first gray value into output picture data of the first color having a second gray value, the imaginative gamma curve being different from a gamma curve of the first color, and wherein the transformed second gray value of the first color represents the same luminance as a gray value of the imaginative gamma curve, wherein the gray value of the imaginative gamma curve is substantially equal to the first gray value.

8. The liquid crystal display of claim 7, wherein the input picture data and the output picture data are represented by a plurality of bits.

9. The liquid crystal display of claim 8, wherein a bit number of the input picture data and a bit number of the output picture data are the same or different from each other.

10. The liquid crystal display of claim 9, wherein a portion of the bits of the output picture data is referred to display a picture by means of a frame rate control.

11. The liquid crystal display of claim 7, wherein the first color and the second color are selected from red, green, blue and other colors, and the first color and the second color are different.

12. The liquid crystal display of claim 7, further comprising a look-up table, wherein the color correction unit is further configured to refer to the look-up table to transform the input picture data into the output picture data.

* * * * *